United States Patent [19]

Nakajima et al.

[11] Patent Number: 4,612,734

[45] Date of Patent: Sep. 23, 1986

[54] GRINDING MACHINE

[75] Inventors: Motoharu Nakajima, Toba; Seishiro Sakane, Mie; Norimichi Sato, Shizuoka; Etsuro Haruta, Shimizu, all of Japan

[73] Assignees: Shinko Electric Co., Ltd.; Nippon Kokan Kabushiki Kaisha, both of Japan

[21] Appl. No.: 726,065

[22] Filed: Apr. 23, 1985

[51] Int. Cl.[4] ..... B24B 23/02

[52] U.S. Cl. ..... 51/170 PT

[58] Field of Search ..... 51/170 R, 170 T, 170 MT, 51/170 PT, 266

[56] References Cited

U.S. PATENT DOCUMENTS 1,972,315 9/1934 Ramey ..... 51/170 T
2,683,336 7/1954 Scace ..... 51/170 MT

FOREIGN PATENT DOCUMENTS 878440 6/1953 Fed. Rep. of Germany .... 51/170 T
533399 9/1955 Italy ..... 51/170 T

*Primary Examiner*—Roscoe V. Parker
*Attorney, Agent, or Firm*—Kane, Dalsimer, Kane, Sullivan and Kurucz

[57] ABSTRACT

A grinding machine includes a casing having intake apertures for introducing the air and discharge apertures for discharging the air. A motor is mounted within the casing and has a rotatable shaft. A fan member is fixedly mounted on the shaft for rotation therewith and has a mounting portion and a plurality of blades provided on the mounting portion for flowing the air through the casing from the intake apertures to the discharge apertures for cooling the motor. A grinding wheel is secured to the mounting portion.

9 Claims, 2 Drawing Figures

GRINDING MACHINE

BACKGROUND OF THE INVENTION

1. Field of the Invention

This invention relates to a grinding machine of the type designed to be held by hand for operation.

2. Prior Art

There are known various compact grinding machines which can be held by hand and operated for finishing a welded portion and for removing flashes from a molding. One such conventional grinding machine 10 shown in FIG. 1 is a pot-type one. The grinding machine 10 comprises a cylindrical housing 12 having one end opened, and a high-frequency induction motor 14. The motor 14 includes a cylindrical casing 14*a* having one end opened and supported within the housing 12, a lid 14*b* attached to the open end of the casing 14*a* for closing it, a rotatable shaft 14*c* extending through the lid 14*b* and an end wall 14*d* of the casing 14*a* and rotatably borne by a pair of bearing members 16 and 18 secured respectively to the end wall 14*d* and the lid 14*b*, a rotor 14*e* fixedly mounted on the shaft 14*c* for rotation therewith, and a stator 14*f* mounted within the casing 14*a* in surrounding relation to the rotor 14*e*. The shaft 14*c* extends outwardly of the housing 12, and a flange member 20 of a disc-shape is fixedly mounted on the outer end portion of the shaft 14*c*. A grinding wheel 22 is mated with the outer face of the flange member 20 in coaxial relation thereto. A retaining member 24 is snugly fitted in central apertures of the grinding wheel 22 and flange member 20, and a bolt 25 is passed through the grinding wheel 22 and the flange member 20 and is threaded into the outer end of the shaft 14*c*, so that the grinding wheel 22 is clamped between a flange 24*a* of the retaining member 24 and the flange member 20 and is retained in place. Thus, the flange member 20 serves as a grinding wheel-mounting member. A propeller-type fan 26 for cooling the motor 14 is fixedly mounted on the inner end of the shaft 14*c* for rotation therewith. An annular passageway 28 is defined by the inner peripheral surface of the housing 12 and the outer peripheral surface of the casing 14*a*. A plurality of intake apertures 12*a* are formed through an end wall 12*b* of the cylindrical housing 12. With this construction, upon rotation of the motor 14, the fan 26 is rotated to feed the air through the intake apertures 12*a* and the annular passageway 28 and is discharged from an open end 28*a* of the passageway 28 as indicated by arrows in FIG. 1, so that the lid 14*b* and the peripheral wall of the casing 14*a* are cooled by the air so introduced into the housing 12 to thereby prevent an undue heating of the motor 14.

It is desirable that the grinding machine of this type can be as compact and lightweight as possible since it is held by hand and operated to carry out the grinding. The conventional grinding machine 10 has been found not entirely satisfactory, however, in these respects because of the fact that the fan 26 and the flange member 20 for supporting the grinding wheel 22 are mounted separately on the shaft 14*c* and is spaced along an axis thereof.

SUMMARY OF THE INVENTION

It this therefore an object of this invention to provide a grinding machine of the type which is more compact and lightweight and can be manufactured at lower costs.

According to the present invention, there is provided a grinding machine which comprises a casing having intake port means for introducing the air and discharge port means for discharging the air; a motor mounted within said casing and having a rotatable shaft; a fan member fixedly mounted on said shaft for rotation therewith and having a mounting portion and a plurality of blades provided on said mounting portion for flowing the air through said casing from said intake port means to said discharge port means for cooling said motor; and a grinding wheel secured to said mounting portion.

DESCRIPTION OF THE PREFERRED EMBODIMENT OF THE INVENTION

Figure 2:
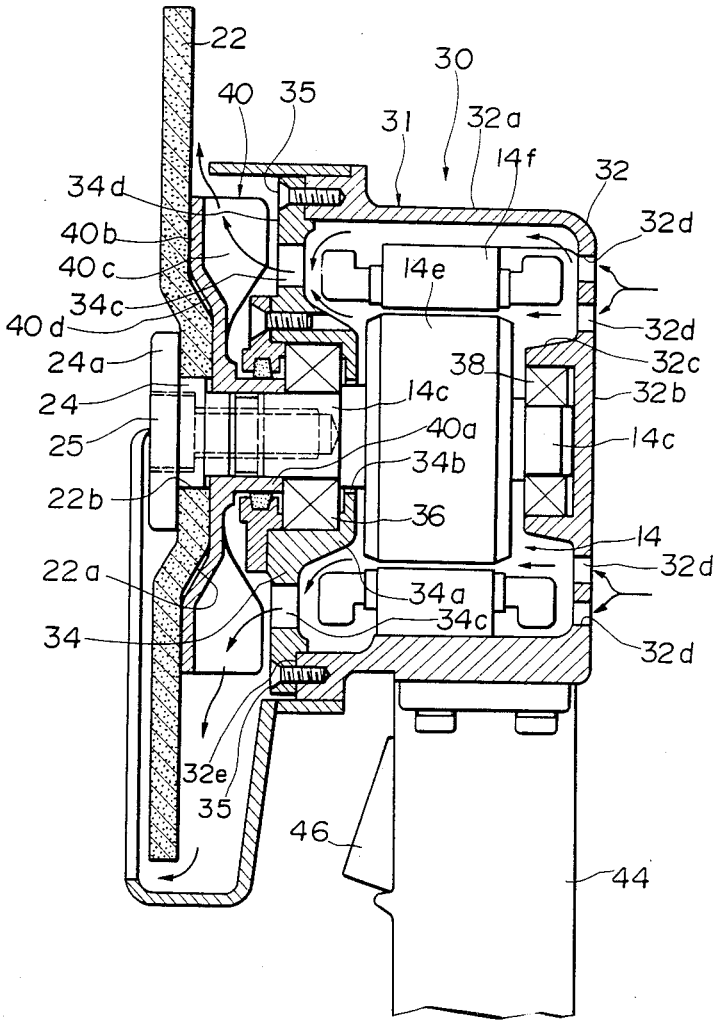
FIG. 2 is a cross-sectional view of a grinding machine provided in accordance with the present invention.

A grinding machine 30 shown in FIG. 2 comprises a casing or housing 31 composed of a cylindrical body 32 having one end 32*e* opened and a lid 34 of a generally disc-shape attached to the open end 32*e* by screws 35. The cylindrical casing body 32 is defined by a peripheral wall 32*a* and an end wall 32*b* formed at one end of the peripheral wall 32*a* remote from the open end 32*e*. The end wall 32*b* has a central tubular portion 32*c* formed at its inner face. A plurality of intake apertures or ports 32*d* are formed through that portion of the end wall 32*b* lying between the peripheral wall 32*a* and the tubular portion 32*c*. The lid 34 has a central hollow hub 34*a* having an aperture 34*b* formed therethrough. A plurality of discharge apertures or ports 34*c* are formed through a radial outer portion 34*d* of the lid. A motor 14 comprises a rotatable shaft 14*c* rotatably borne by a pair of bearing members 36 and 38 received respectively in the hub 34*a* of the lid 34 and the tubular portion 32*c* of the end wall 32*b*, the shaft 14*c* extending through the aperture 34*b* of the lid 34. The motor 14 also includes a rotor 14*e* fixedly mounted on the shaft 14*c* for rotation therewith, and a stator 14*f* mounted within the casing body 32 in surrounding relation to the rotor 14*e*.

A fan member 40 of a one-piece molded construction is fixedly mounted on the outer end of the shaft 14c for rotation therewith. The fan member 40 includes a tubular hub portion 40*a* snugly fitted on the shaft 14*c*, a mounting portion 40*b* of a generally disc-shape formed around the hub portion 40*a* at its outer end and disposed generally perpendicular to the shaft 14*c*, and a plurality of blades 40*c* formed on the inner face of the mounting portion 40*b* facing the lid 34 and extending radially of the hub portion 40*a*. The outer face of the mounting portion 40*b* is depressed at its inner radial portion to provide a circular recess 40*d*.

A grinding wheel 22 is offset at its central portion to provide a circular projection 22*a* which is generally complementary in shape to the recess 40*d*, and a central aperture 22*b* is formed through the central portion of the grinding wheel 22. The grinding wheel 22 is mated with the outer face of the mounting portion 40*b* of the fan member 40 with the projection 22*a* fitted in the recess 40*d* of the mounting portion 22. A retaining member 24 is fitted in the central aperture 22*b* and the hub portion 40*a*, and a bolt 25 is threaded through the retaining member 24 into the outer end of the shaft 14*c*, so that the grinding wheel 22 is firmly clamped between a flange 24*a* of the retaining member 24 and the mounting portion 40*b* to hold the grinding wheel 22 against movement.

A handgrip 44 is fixedly secured at one end to the peripheral wall 32*a* of the casing body 32, and a switch 46 for operating the motor 14 is mounted on the handgrip 44 handgrip 44.

In operation, the switch 46 is operated to drive the motor 14 to rotate the shaft 14*c* together with the fan member 40 and the grinding wheel 22, so that the air is drawn by the blades 40*c* of the fan member 40 through the intake apertures 32*d* into the casing body 32, and is passed through the motor component parts in the casing body 32 and is discharged from the discharge apertures 34*c*, as indicated by arrows in FIG. 2. Thus, during the passing of the air through the casing body 32, the motor 14 is suitably cooled.

The fan member 40 serves as both a cooling fan for cooling the motor 14 and a grinding wheel-mounting member. More specifically, the provision of the mounting portion 40*b* of the fan member 40 obviates the need for a separate grinding wheel-mounting member. Therefore, the shaft 14*c* can be reduced in length, so that the overall size of the grinding machine 30 can also be reduced. In addition, in this embodiment, there is not required a housing for accommodating the casing body 32 as is the case with the prior art grinding machine shown in FIG. 1. This also contributes to the reduction of the size and weight of the grinding machine. Further, since the air is passed through the casing body 32, the motor 14 can be cooled efficiently. Further, the fan member 40 is disposed outwardly of the casing body 32, the diameter of the fan member 40 can be suitably increased to provide an increased cooling capacity. Thus, the motor 14 is cooled so efficiently that the core of the motor can be reduced in thickness since a great radiation is not required for the core. As described above, the number of component parts of the grinding machine 30 can be reduced so that it can be manufactured at lower costs.

Figure 1:
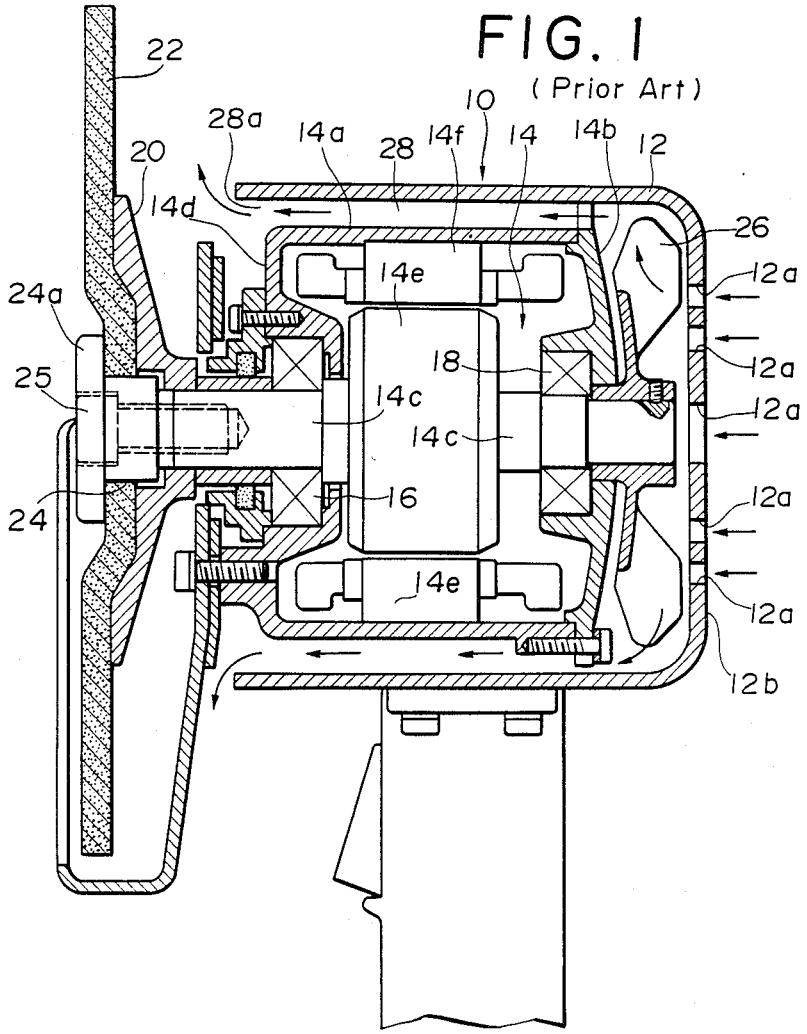
FIG. 1 (Prior Art)
FIG. 1 is cross-sectional view of a grinding machine provided in accordance with the prior art.

In comparison with the conventional grinding machine 10 shown in FIG. 1, the grinding machine 30 according to the present invention is about 30% less in weight and is about 25% less in length along the axis of the shaft 14*c*.

While the grinding machine according to the present invention has been specifically shown and described herein, the invention itself is not to be restricted to the exact showing of the drawings or the description thereof. For example, although the fan member 40 is made of a one-piece molded construction, the blades 40*c* may be fixedly secured to the mounting portion 40*b* by an adhesive, screws or welding to form a unitary construction.

What is claimed is:

1. A grinding machine comprising:

(a) a casing comprising a tubular body having an end wall at one end thereof while the other end is open, said end wall having a plurality of intake apertures formed therethrough, said casing comprising a disc-shaped lid secured to said open end of said casing body and having a plurality of discharge apertures;

(b) a motor mounted within said casing body and having a shaft rotatably mounted on said casing for rotation about an axis thereof, said shaft extending generally coaxially with said casing body and projecting outwardly of said lid;

(c) a fan member fixedly mounted on that portion of said shaft extending outwardly of said lid, said fan member comprising a mounting portion of a generally disc-shape disposed adjacent to said lid perpendicularly to said shaft and a plurality of radial blades formed integrally on one face of said mounting portion directed toward said lid;

(d) a grinding wheel mated with and secured at one face to the other face of said mounting portion, whereby upon rotation of said motor, ambient air is drawn by said blades into said casing through said intake apertures and is discharged from said discharge apertures.

2. A grinding machine according to claim 1 wherein the plurality of air intake apertures and air discharge apertures are spaced about the end wall and lid casing, respectively, to provide improved cooling.

3. A grinding machine according to claim 2 wherein the fan has a greater diameter than the motor to provide improved cooling and wherein the casing is of relatively thin construction.

4. A grinding machine according to claim 3 wherein the axial length of the casing is less than the radial length of the casing.

5. A grinding machine according to claim 4 wherein the grinding wheel extends radially outwardly of the casing body and wherein on at least one side of the grinding machine an opening is provided between the casing body and the grinding wheel to allow cooling air to pass therethrough.

6. A grinding machine according to claim 5 wherein the grinding machine includes a single casing which is the casing including the tubular body.

7. A grinding machine according to claim 6 wherein the casing is spaced from the motor to enable free flow of cooling air therebetween.

8. A grinding machine according to claim 7 further comprising a handle extending perpendicular to the axis of the shaft to facilitate upright use of the grinding machine.

9. A grinding machine according to claim 1, in which said fan member is of a one-piece molded construction.

* * * * *